US008899950B2

(12) United States Patent
Kapadia et al.

(10) Patent No.: US 8,899,950 B2
(45) Date of Patent: Dec. 2, 2014

(54) SLIDE VALVE FOR SCREW COMPRESSOR

(75) Inventors: Neville Dhunjishaw Kapadia, Chesterfield, MO (US); Michael Edward Terwelp, Katy, TX (US); Bernard Dale Conley, Palmyra, MO (US); Timothy Keene Heimonen, LaGrange, MO (US)

(73) Assignee: Gardner Denver, Inc.

( * ) Notice: Subject to any disclaimer, the term of this patent is extended or adjusted under 35 U.S.C. 154(b) by 487 days.

(21) Appl. No.: 13/328,597

(22) Filed: Dec. 16, 2011

(65) Prior Publication Data

US 2013/0156624 A1 Jun. 20, 2013

(51) Int. Cl.

| | |
|---|---|
| ***F04C 18/16*** | (2006.01) |
| ***F04C 28/12*** | (2006.01) |
| ***F04C 28/14*** | (2006.01) |

(52) U.S. Cl.

CPC ..... *F04C 18/16* (2013.01); *F04C 28/12* (2013.01); *F04C 28/14* (2013.01)

USPC ..... 418/201.2; 418/201.1

(58) Field of Classification Search

CPC ..... F04C 18/16; F04C 28/12; F04C 28/14

USPC ..... 418/201.1, 201.2

See application file for complete search history.

(56) References Cited

U.S. PATENT DOCUMENTS

| | | | | |
|---|---|---|---|---|
| 1,221,702 A | | 4/1917 | Douglas | |
| 3,088,658 A | * | 5/1963 | Wagenius | 418/201.2 |
| 3,314,597 A | | 4/1967 | Schibbye | |
| 3,874,828 A | | 4/1975 | Herschler et al. | |
| 3,910,731 A | * | 10/1975 | Persson et al. | 418/201.1 |
| 4,042,310 A | * | 8/1977 | Schibbye et al. | 418/201.2 |
| 4,147,475 A | | 4/1979 | Shoop et al. | |
| 4,478,054 A | | 10/1984 | Shaw et al. | |
| 4,565,508 A | * | 1/1986 | Lindstrom | 418/201.2 |
| 5,540,565 A | | 7/1996 | Bearint | |
| 5,678,985 A | | 10/1997 | Brooke et al. | |

(Continued)

FOREIGN PATENT DOCUMENTS

| | | | |
|---|---|---|---|
| GB | 384355 A | * | 12/1932 |
| GB | 2158881 | | 11/1985 |

OTHER PUBLICATIONS

International Search Report regarding related international application PCT/US2012/69542, filed Dec. 13, 2012.

(Continued)

*Primary Examiner* — Mary A Davis

(74) *Attorney, Agent, or Firm* — James B. Conte; Husch Blackwell LLP

(57) ABSTRACT

An assembly of a compressor for pressurizing a fluid includes a main housing having a portion being substantially planar. The housing defines at least two parallel intersecting bores. At least two rotors are journaled for rotation within the bores. A plurality of vent channels in the main housing extend outwardly from at least one bore through the portion being substantially planar. The vent channels are configured for the fluid to flow through the vent channels. A slide valve assembly is operably connected to the housing proximate the plurality of vent channels. The slide valve assembly has a valve plate wherein the valve plate has a substantially planar side that is sealingly engaged with the planar portion of the main housing. The valve plate is positioned into one of a plurality positions relative to the vent channels.

2 Claims, 8 Drawing Sheets

(56) References Cited

U.S. PATENT DOCUMENTS

| | | | | |
|---|---|---|---|---|
| 6,135,744 | A * | 10/2000 | Andersen et al. | 418/201.2 |
| 6,422,846 | B1 | 7/2002 | Zhong et al. | |
| 6,739,853 | B1 * | 5/2004 | Tang et al. | 418/201.2 |
| 7,891,955 | B2 | 2/2011 | Picouet | |
| 7,993,120 | B2 | 8/2011 | Bush | |
| 2008/0240939 | A1 * | 10/2008 | Picouet | 418/201.2 |
| 2011/0038747 | A1 * | 2/2011 | Shoulders | 418/201.2 |
| 2013/0091892 | A1 * | 4/2013 | Nemit et al. | 418/201.1 |
| 2013/0216414 | A1 * | 8/2013 | Kopko et al. | 418/201.2 |

OTHER PUBLICATIONS

Written Opinion of the International Searching Authority regarding related international application PCT/US2012/69542, filed Dec. 13, 2012.

Search History regarding related international application PCT/US2012/69542, filed Dec. 13, 2012.

The International Preliminary Report on Patentability, mailed Jun. 26, 2014, for PCT/US2012/069542 which claims priority from the present application (6 pages).

* cited by examiner

SLIDE VALVE FOR SCREW COMPRESSOR

CROSS-REFERENCE TO RELATED APPLICATIONS

None

BACKGROUND OF THE INVENTION

Rotary screw compressors having control valves to allow for escape of compressed air in a working chamber are known.

U.S. Pat. No. 3,314,597, Screw Compressor, concerns a screw compressor having a low pressure end plate and a casing. A working chamber is provided in the casing. The chamber is substantially in the form of two intersecting cylindrical bores of the same size having parallel axes located in the same horizontal plane. The casing is provided with a recess communicating with an axial high pressure port. The recess extends axially from a high pressure end wall towards the low pressure end plate. The recess and a barrel wall of the working space intersect along two straight edges parallel with the axes of the bores. The recess has a cross-section in the form of a segment of the circle. An axial slidable valve is located in the recess. The valve is provided with a cylindrical wall sealingly cooperating with the barrel wall of the recess.

U.S. Pat. No. 3,874,828, Rotary Control Valve for Screw Compressors, Herschler, et al, concerns a liquid injected helical screw gas compressor having a capacity control valve. The control valve includes a cylindrical plug fitted in a chamber which is adjacent to and in communication with the compressor's working chamber by way of a series of auxiliary ports. The control valve member includes a control edge with the auxiliary ports for controlling the gas throughput and the built-in volume ratio of the compressor.

U.S. Pat. No. 4,147,475, Control System for Helical Screw Compressor concerns a helical screw compressor having a rotary capacity control valve, a compressor inlet throttling valve, and a pressure relief valve for venting the compressor discharge conduit. A control circuit senses pressure in the compressed air supply system downstream of the compressor and operates the capacity control valve, inlet throttling valve and pressure relief valve in a predetermined sequence to provide an improved power consumption characteristic for variable demand compressor applications. The control circuit includes a hydraulic control valve and an actuator for operating the rotary capacity control valve to regulate compressor throughput to maintain a predetermined pressure without over pressuring the supply during operating conditions of reduced demand for compressed air. The compressor in part is characterized by a cylinder bore in the housing in which is disposed the rotary capacity control valve.

SUMMARY OF THE INVENTION

The present invention is directed toward a helical screw compressor having a slide valve assembly to reduce the volume of compressible fluid being output by the compressor. In more detail an embodiment of the invention includes a variable output helical screw compressor for pressurizing a compressible fluid. The compressor has a main housing. The main housing has a bottom with a portion being substantially planar. The main housing defines at least at least two parallel intersecting bores of similar diameter. At least two rotors are journaled for rotation within said bores. A plurality of vent channels in said main housing extend outwardly from at least one bore and through said bottom portion being substantially planar. A slide valve assembly is operably connected to said housing proximate said plurality of vent channels, said slide valve assembly having a valve plate. The valve plate has a substantially planar top that is sealingly engaged with said planar portion of said bottom of said main housing. The valve has a position relative to said vent channels. The position is selectable from the group of positions consisting of fully open, fully closed and intermediate or can be controlled to an infinite number of positions.

BRIEF DESCRIPTION OF THE DRAWINGS

The accompanying drawings form a part of the specification and are to be read in conjunction therewith, in which like reference numerals are employed to indicate like or similar parts in the various views, and wherein.

DETAILED DESCRIPTION OF THE INVENTION

The following detailed description of the invention references the accompanying drawing figures that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 1:
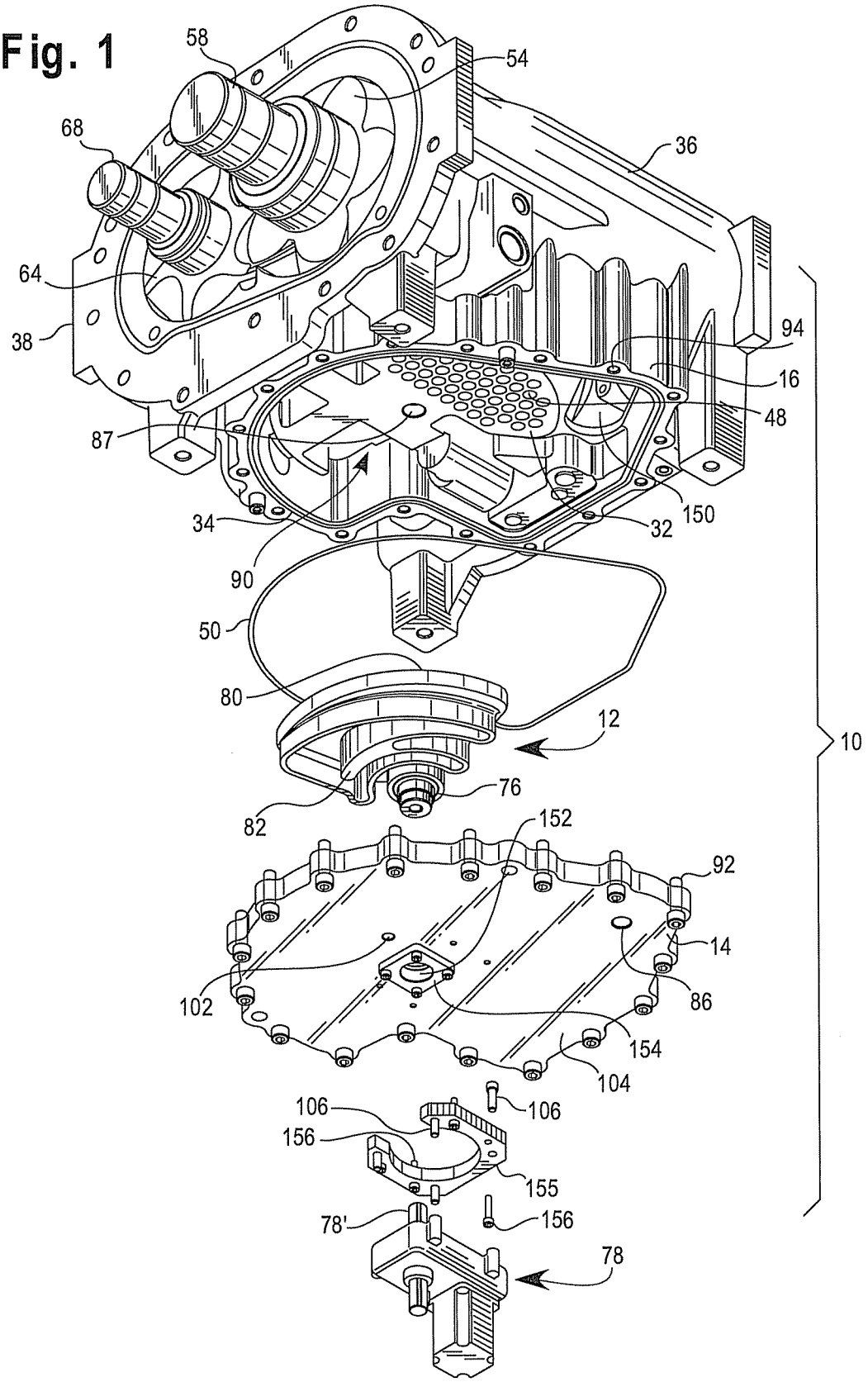
FIG. 1 is an exploded view of a compressor assembly (an air end which has been stripped down) embodying the invention looking into the bottom of the assembly.
Figure 2A:
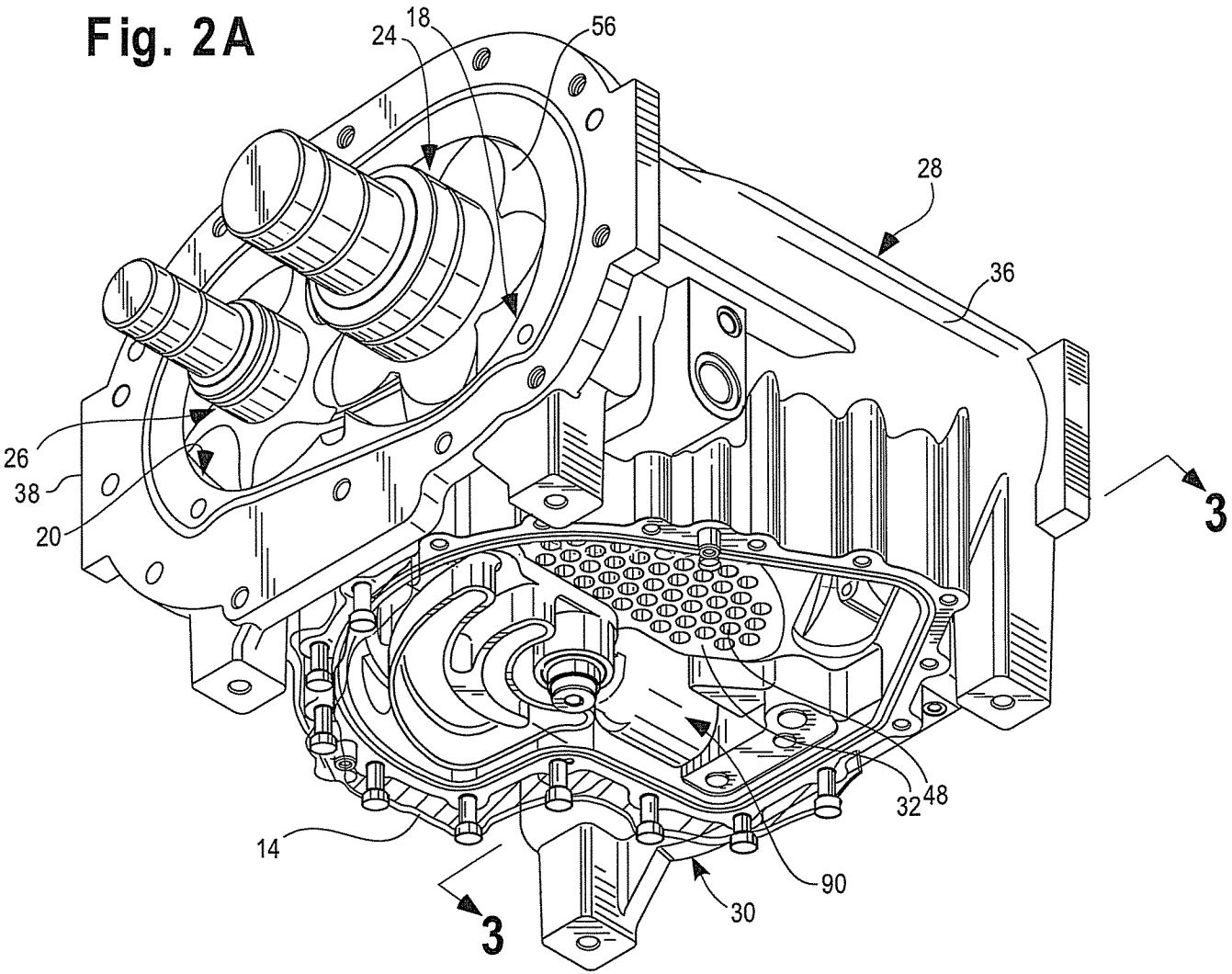
FIG. 2A is a perspective view of the assembly shown in FIG. 1 looking into the bottom of the assembly; the valve cover has been cut away and the valve plate is fully open; the motor shown in FIG. 1 has been omitted for convenience.
Figure 2B:
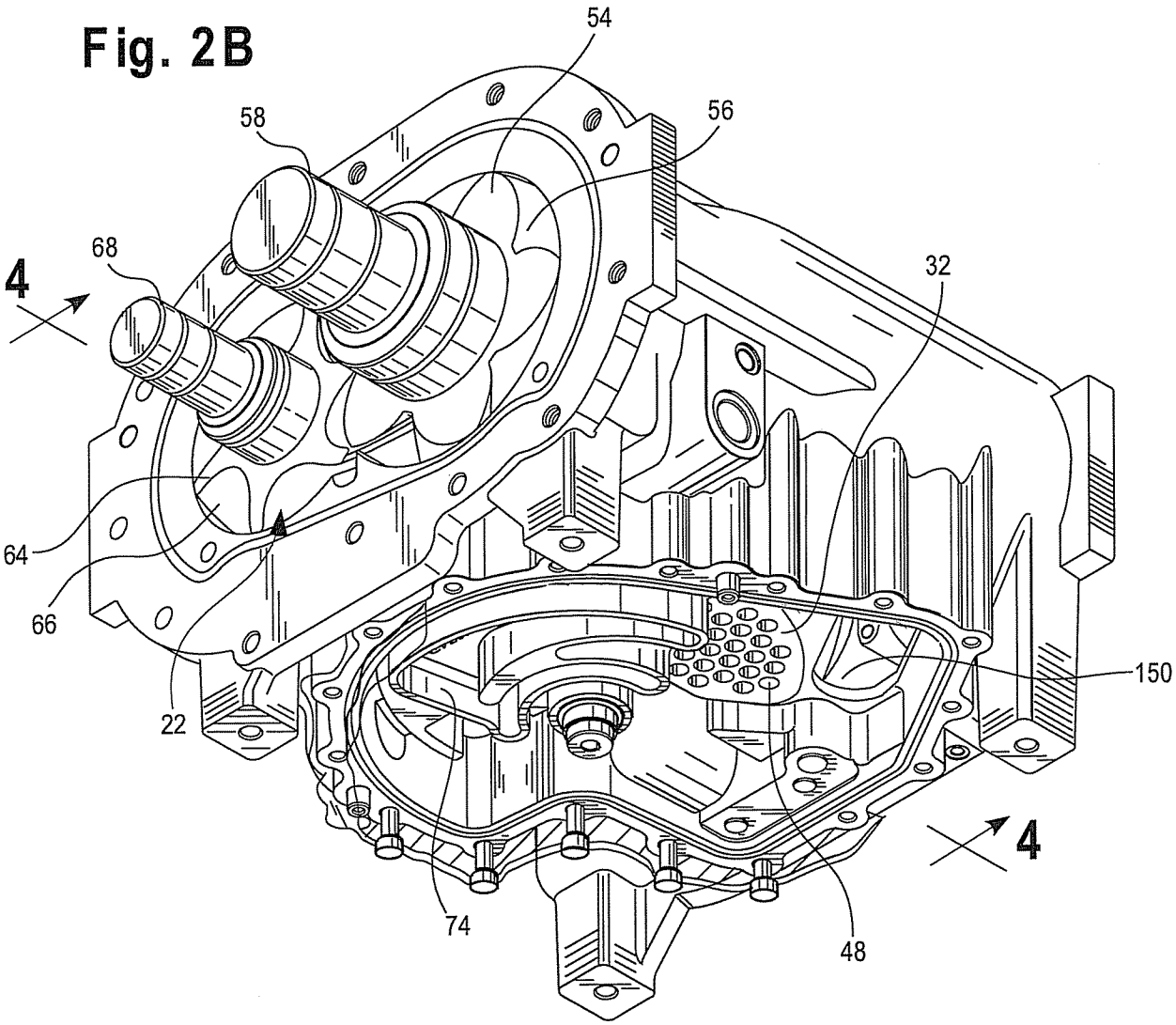
FIG. 2B is a perspective view of the assembly shown in FIG. 2A except the valve plate is only partially open.
Figure 2C:
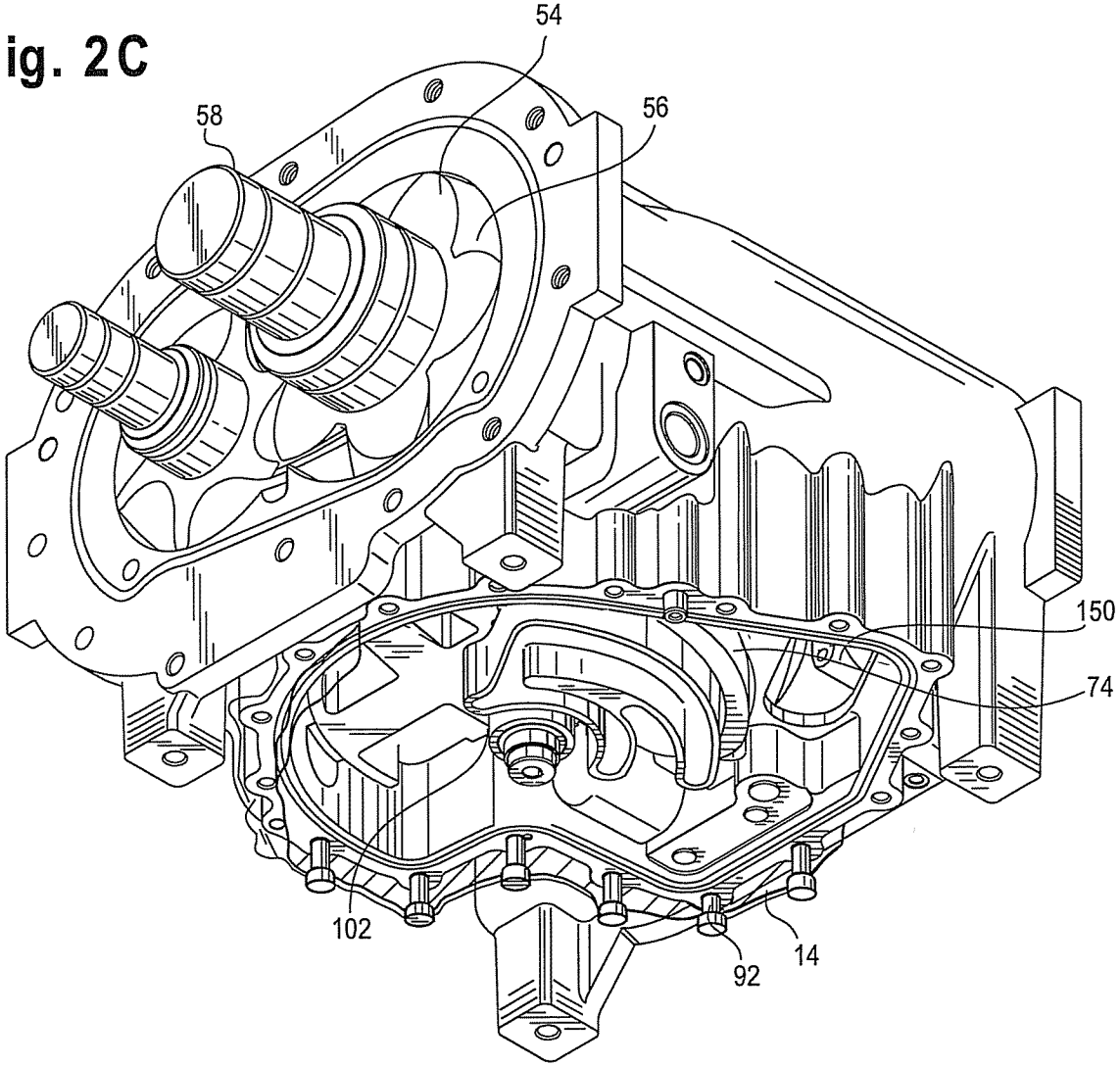
FIG. 2C is a perspective view of the assembly shown in FIG. 2A except the valve plate is fully closed.

Now turning to FIG. 1, the present invention is directed toward an improved helical screw compressor having an air end 10. The air end 10 includes a slide valve assembly 12 to control the output volume of pressurized fluid to a compressed fluid system and a cover 14 covering the valve plate of slide valve assembly 12 and defining a chamber 90 to gather and recirculate vented fluid.

Figure 3:
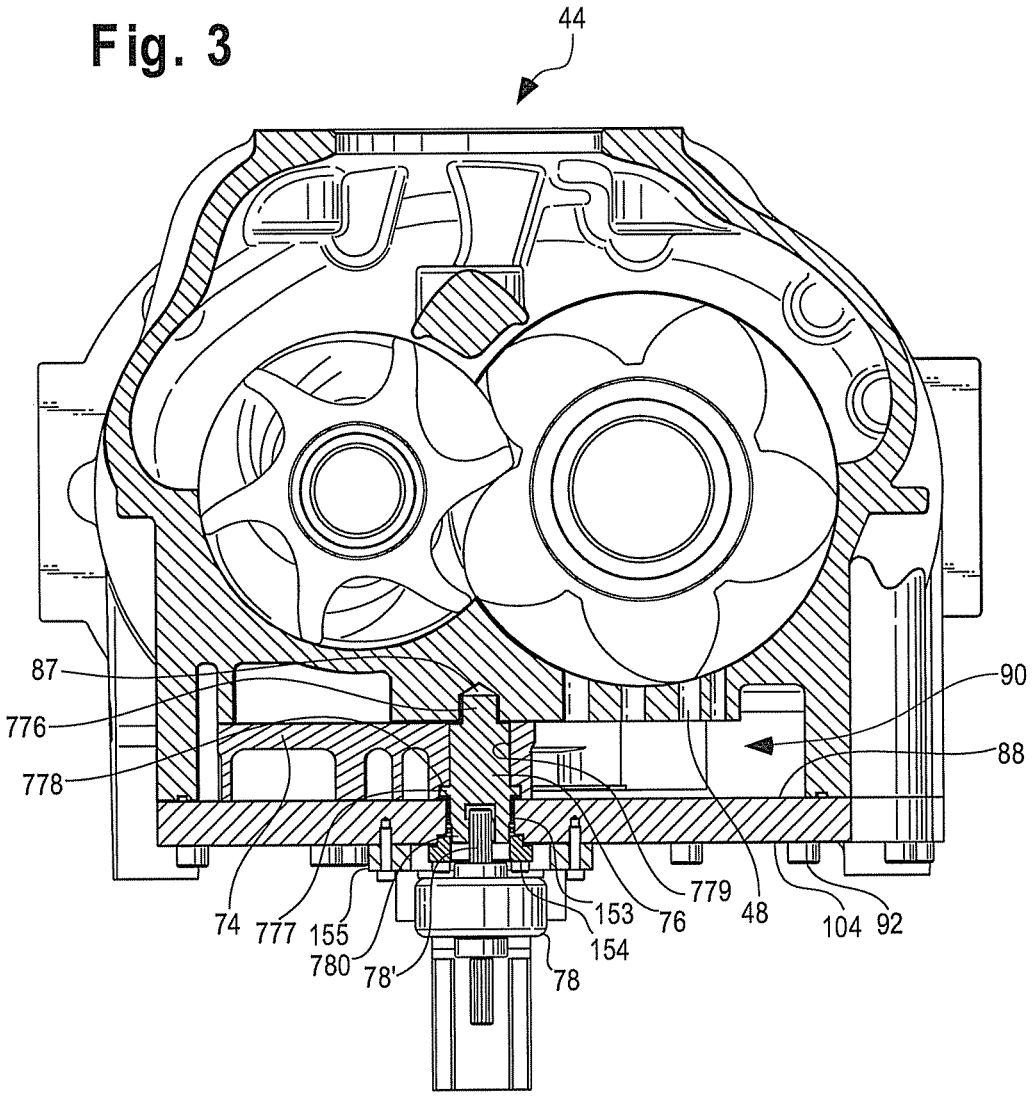
FIG. 3 is a modified cross-section of the assembly of the air end shown in FIG. 2A taken in the direction of view line 3-3 around the rotors (the rotors have not been sectioned); the motor omitted from FIG. 2A is shown.

As shown in FIGS. 1, 2 and 3*a*-3*c*, air end 10 comprises a main housing 16 wherein main housing 16 includes a first bore 18 and a second bore 20. First bore 18 and second bore 20 are parallel intersecting bores, substantially cylindrical, substantially the same size, and are cut on parallel axes that generally lie in the same, substantially horizontal plane as shown. As best illustrated in FIGS. 3*a*-3*c*, first bore 18 and second bore 20 comprise a main fluid chamber 22 for the compression and pressurization of a fluid, such as air or gases. The fluid chamber 22 can be called a working chamber. As further shown air end 10 also includes a first rotor 24 and a second rotor 26 that is matingly engaged with first rotor 24.

Figure 4A:
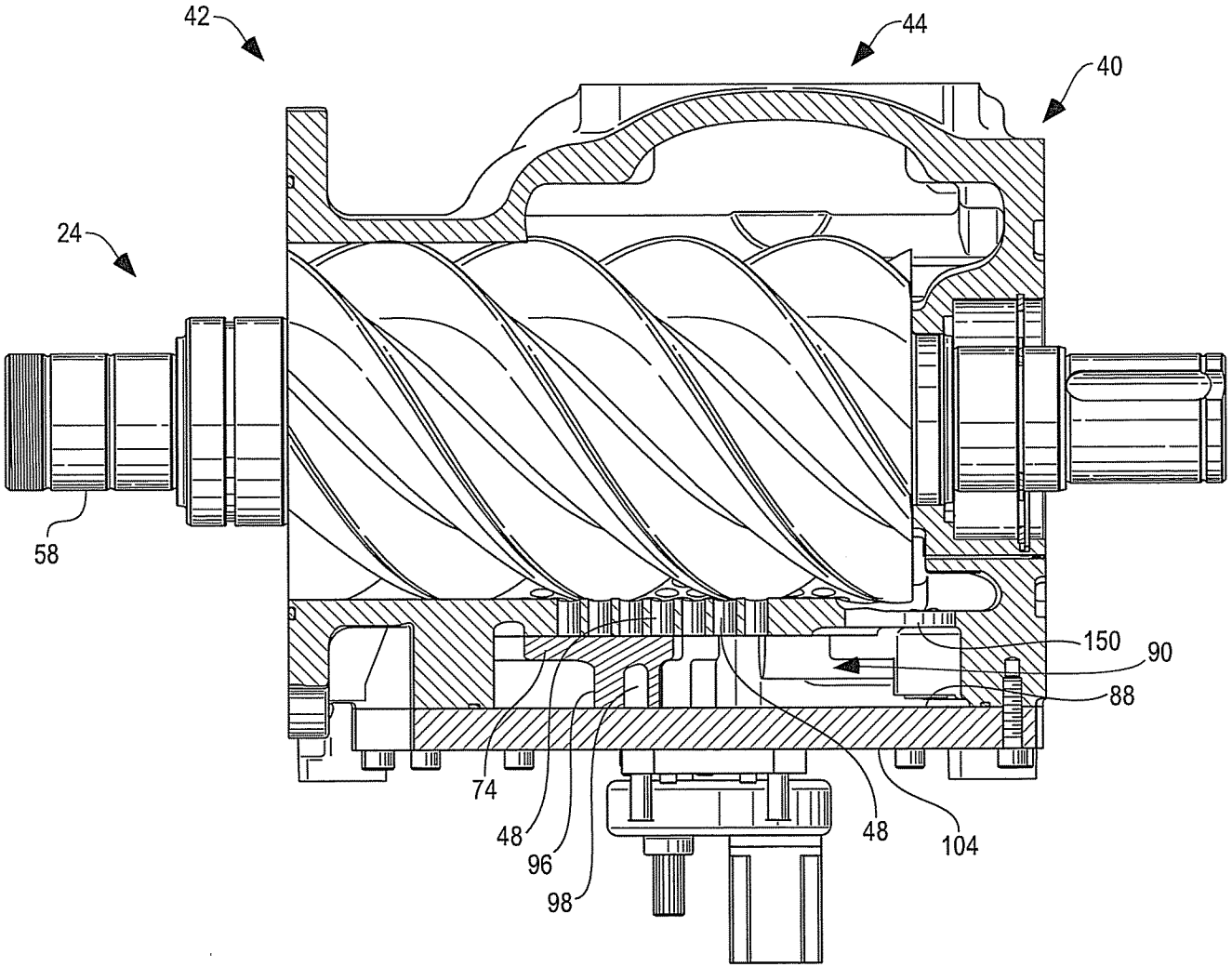
FIG. 4A is a cross-section of the assembly of the air end shown in FIG. 2B taken in the direction of view line 4-4; the motor omitted from FIG. 2B is shown.
Figure 4B:
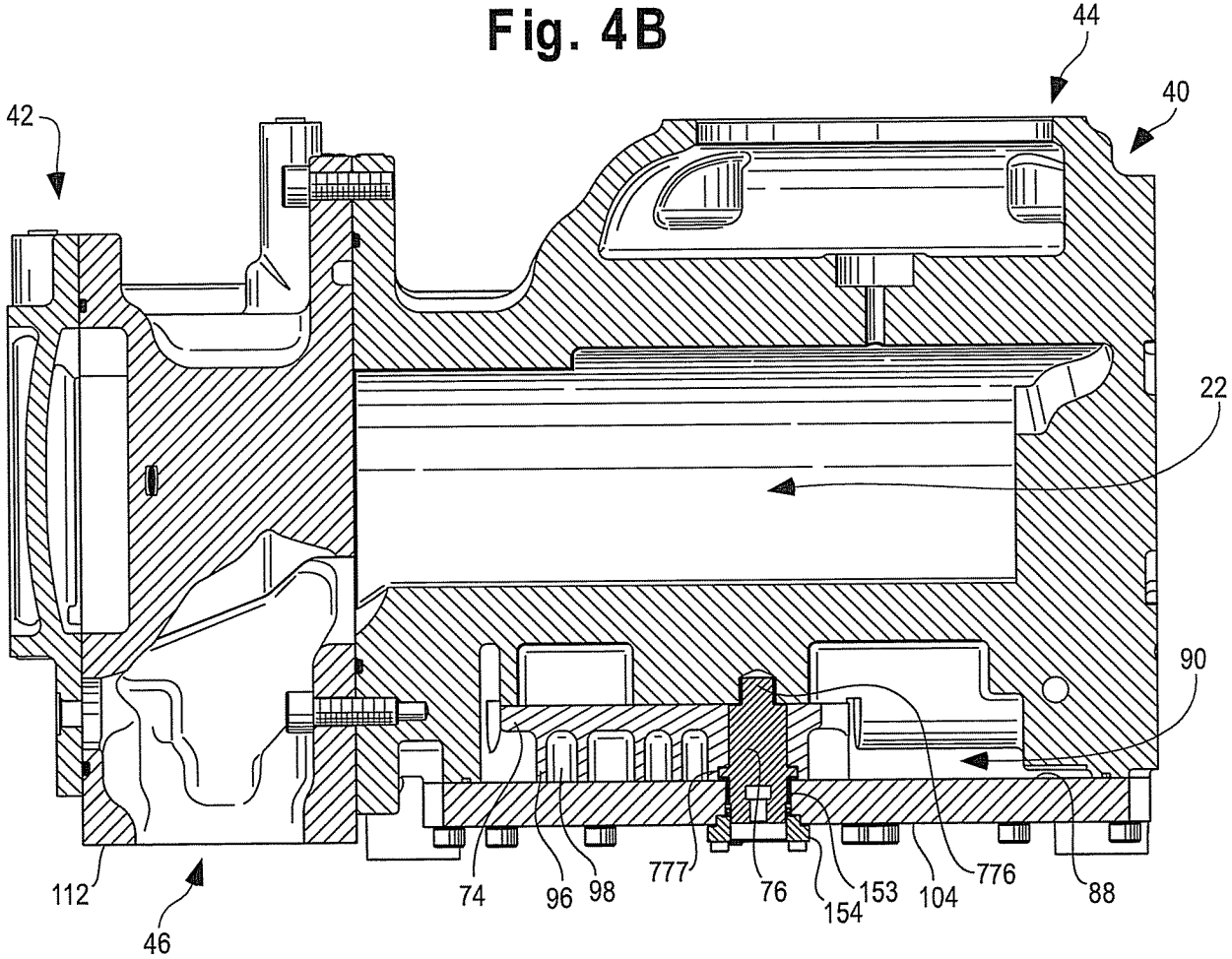
FIG. 4B is a cross-section of the assembly of the air end shown in FIG. 2A taken in the direction of a view line similar to 4-4 accept at a slightly different position to show the air outlet; the discharge bearing housing omitted from FIG. 4A is shown; the motor omitted from FIG. 2A is shown.

Main housing 16 further includes a top 28 and a bottom 30. The bottom 30 has a substantially planar recessed portion 32. An outer rim 34 surrounds the recessed portion. The rim 34 can be considered a sidewall 34. The housing has a first side 36 and a second side 38. Main housing 16 further includes and inlet end 40 and an outlet end 42. See FIGS. 4A and 4B. Air end 10 includes at least one inlet orifice 44 proximate inlet end 40 and at least one outlet orifice 46 proximate outlet end 42. See FIGS. 4A and 4B. The outlet 46 opens through the discharge bearing housing 112. Main housing 16 includes a plurality of vent channels 48 that extend outwardly from first bore 18 and continuously extend through recessed portion 32 of bottom 30 of main housing 16 thereby putting recessed portion 32 of bottom 30 in fluid communication with main fluid chamber 22. Vent channels 48 may be distributed along the width and length of first bore 18 as shown and may be configured in a pattern, such as the pattern present in the embodiment shown. Another embodiment may include vent channels 48 through second bore 20 or through both first bore 18 and second bore 20.

Main housing 16 is typically cast and machined, or may be formed in any other manner known or hereafter developed in the art. Main housing 16 may be steel or any other suitable industrial metal known or hereafter developed.

First rotor 24 comprises a plurality of helical lobes 54 and a corresponding plurality of helical grooves 56. An embodiment of first rotor 24 includes five helical lobes and grooves. First rotor 24 further includes shaft 58 that first rotor 24 rotates therewith. Shaft 58 corresponds to the first rotor's axis of rotation.

Further, second rotor 26 comprises a plurality of helical lobes 64 and a plurality of corresponding helical grooves 66. An embodiment of second rotor 26 includes six helical lobes 64 and grooves 66. The grooves 66 of second rotor 26 are configured to receive the lobes 54 of first rotor 24 and the grooves 56 of first rotor 24 are configured to receive the lobes 64 of second rotor 26. Second rotor 26 further comprises a shaft 68 that second rotor 26 rotates therewith. Shaft 68 corresponds to the second rotor's central axis of rotation.

Shaft 58 is journaled for rotation. Shaft 58 thereby defines the axis of rotation for first rotor 24 and first rotor 24 is free to rotate with shaft 58 within first bore 18 when drivingly engaged by a motor or other transmission. Shaft 68 is journaled for rotation. Shaft 68 thereby defines the axis of rotation for second rotor 26 and second rotor 26 is free to rotate with shaft 68 within second bore 20 when drivingly engaged by the first rotor. In this case because the compressor is oil flooded the rotors engage. If the compressor were dry or were a water flooded compressor than the second rotor would be drivingly engaged by a gearing assembly coupling the first rotor to the second rotor.

As illustrated the first rotor 24 is drivingly engaged with second rotor 26. Helical lobes 54 of first rotor 24 are configured to matingly engage the helical grooves 66 of second rotor 26. In like manner, lobes 64 of second rotor 26 also matingly engage the grooves 56 of first rotor 24.

Slide valve assembly 12 comprises at least a valve plate 74, a drive shaft 76 and a valve motor 78. Valve plate 74 has a top surface 80, a bottom surface 82, and a perimeter side 84 defining the area of valve plate 74. Valve plate 74 has a thickness defined by top surface 80 and bottom surface 82 that corresponds to the height of sidewall 34 as measured from recessed surface 32. The height is such that when cover 14 is fastened to main housing 16 valve plate 74 is sandwiched between recessed portion 32 of bottom 30 of main housing 16 and a top surface 88 of cover 14. Top surface 80 of valve plate 74 is substantially planar and bears against planar recessed portion 32 of bottom 30 of main housing 16 proximate the pattern of vent channels 48. Further, bottom surface 82 of valve plate 74 bears against top surface 88 of cover 14. Cover 14 is secured to main housing 16 using a plurality of fasteners 92 that are inserted through apertures in cover 14 and into apertures 94 of sidewall 34. A seal 50 is between cover 14 and rim 34. The cover has an aperture 86 which serves to allow connection for piping to allow for the draining of oil. The void between recessed portion 32 of bottom 30 of main housing 16 and top surface 88 of cover 14 defines chamber 90. The chamber 90 may be called a recirculation chamber. Chamber 90 is in fluid communication with inlet orifice 44 and main fluid chamber 22. In more detail the recessed portion 32 of the bottom 30 of the main housing has an outlet 150 which that is fluidly connected to the inlet orifice 44.

The top surface 80 of valve plate 74 and recessed portion 32 of bottom 30 of housing 16 is machined, milled, or otherwise prepared such that valve plate sealingly engages recessed portion 32 of housing 16. Recessed portion 32 is a bottom flat and planar surface of housing 16. Further, bottom surface 82 of valve plate 74 includes a recessed portion 98 resulting in one or more ribs 96 that contact top surface 88 of cover 14 when cover 14 is fastened to main housing 16. The recessed portions 98 may be called a pocket 98. Rib 96 may be a continuous rib as shown or may comprise a pattern of individual ribs 96. The placement of ribs 96 and recesses is configured so that recessed portion 98 is always in fluid communication with reduced pressure air outside the air end. A through hole 102 extending through valve cover 14 fluidly connects the pocket to reduced pressure air, which can be for example outside ambient air. Ribs 96 isolate and fluidly seal off pocket 98 from chamber 90. Having the pocket in fluid communication with reduced pressure air allows for proper sealing engagement between the bottom surface 82 of valve plate 74 and the top surface of cover 14.

Figure 5C:
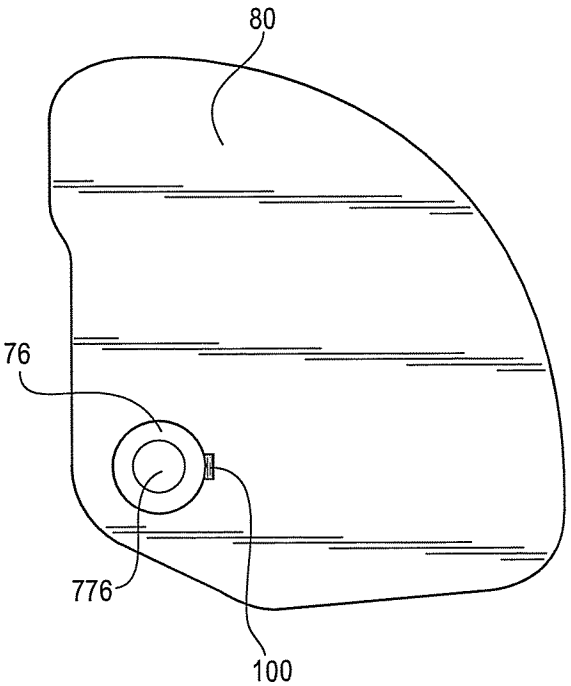
FIG. 5C is a top view of the valve plate shown in FIG. 5A.
Figure 5B:
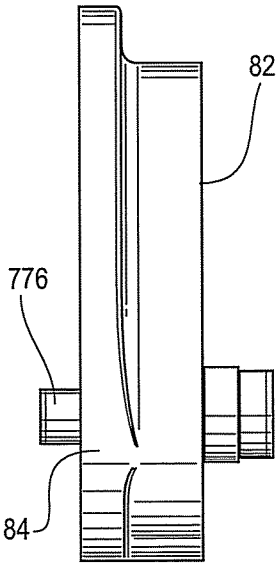
FIG. 5B is a side view of the valve plate shown in FIG. 5A.
Figure 5A:
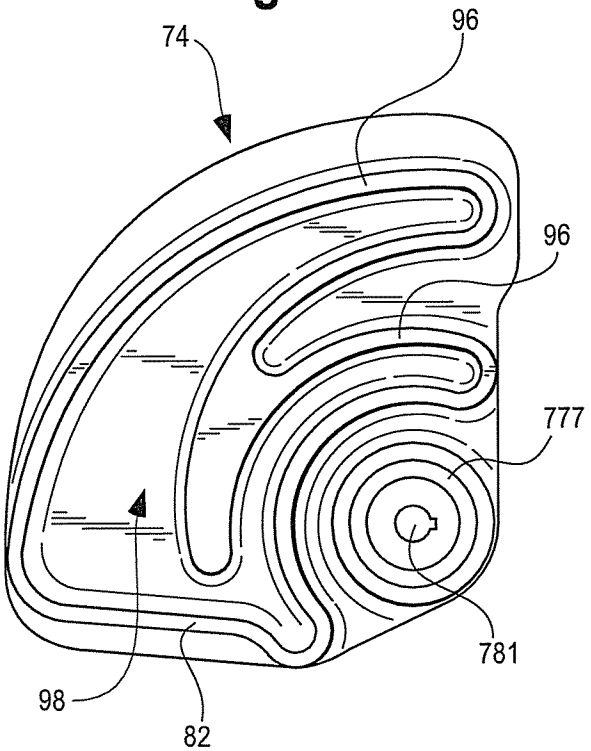
FIG. 5A is a bottom view of one embodiment of the valve plate of the air end of the compressor in accordance with the teachings of the present invention.

The valve plate 74 includes a shaft 76. The shaft is inserted into the valve plate through a bore 779 in the valve plate. The shaft is locked in place relative to the valve plate so the shaft is rotatably fixed relative to the plate so that the plate and shaft rotate about the axis of the shaft as a single unit. The shaft 76 drivingly engages valve plate 74 such that rotating shaft 76 results in radial displacement of valve plate 74. The plate 74 rotates about the axis of shaft 76. The axis of shaft 76 is transverse to the axes of rotation of rotors 24, 26. More particularly the axis of shaft 76 is perpendicular to the axes of rotation of rotors 24, 26. A woodruff key 100 rotatably fixes the shaft 76 relative to the plate 74. Key 100 engages a complimentary notch in valve plate 74 and shaft 76, but key 100 may be any torque transfer mechanism now known or hereafter developed. A first coupling end 776 of the shaft is rotatably disposed within a bore 87 of recessed portion 32. The drive shaft 76 includes a shoulder 777 which abuts up against an interior ledge 778 formed in the bore of the valve plate. The shaft includes a second coupling end 780 opposite the first coupling end 776. The second coupling end has a hollowed area 781 with a notched portion. The notch is visible in FIG. 5A and was intentionally left out of the other figures for convenience. The hollowed area receives motor shaft 78' of motor 78. The motor shaft 78' is rotatably fixed to shaft 76 and in driving engagement with shaft 76. Rotation of motor shaft 78' causes rotation of shaft 76. Drive shaft 76 is shown as a circular shaft, but it may be any shape or configuration now known or hereafter developed.

Drive shaft 76 passes into an aperture 152 in cover 14 and is connected to valve motor shaft 78'. Aperture 152 has a seal 153 therein. A seal cover 154 holds the seal in place. Valve motor 78 is coupled to a bottom surface 104 of cover 14. In more detail motor 78 is coupled to mount 155 via fasteners 106. The mount is coupled to cover 14 by fasteners 156. Valve motor may be an electric, hydraulic, compressed air or other motor known or hereafter developed in the art.

Valve motor 78 drivingly engages drive shaft 76 and rotates shaft 76 and valve plate 74 variably from a fully closed position to a fully open position. The area of valve plate 74 defined by perimeter edge or side 84 is configured to cover the pattern of vent channels 48 when valve plate 74 is in a closed position and to be radially displaced within recessed portion 32. When valve plate 74 is in a fully open position the valve plate 74 is positioned such that pressurized fluid flows from main fluid chamber through all vent channels 48 into chamber 90. When valve plate 74 is in a fully closed position the valve plate 74 is positioned to fully cover all vent channels 48 and thereby prevents fluid from flowing therethrough. When the valve plate 74 is in an intermediate position the valve plate 74 is positioned such that a portion of vent channels 48 are closed and a portion of vent channels 48 are open for fluid to flow therethrough into recirculation chamber 90.

In use, air end 10 of a helical screw compressor of the present invention draws in a fluid into the main fluid chamber 22 through inlet orifice 44 by turning the rotors 24 and 26. The fluid is trapped and compressed in at least grooves 56 and passes out of outlet orifice 46 such that a volume of fluid builds up in the compressed fluid system. When the rotors 24 and 26 rotate within main fluid chamber 22, the fluid drawn in inlet orifice 44 occupies a portion of at least grooves 56. This fluid is displaced and compressed by lobes 64 in a direction from inlet end to the outlet end. If the system demand is less or greater than the supply provided by air end 10, the volume of pressurized fluid can be increased or decreased by variably controlling the volume of fluid displaced out of outlet orifice 46 by adjusting slide valve assembly 12.

Air end 10 comprising slide valve assembly 12 and housing 16 as described herein is configured for an operator to control the volume of fluid being output through outlet orifice 46 to prevent excess pressure build-up in the compressed fluid system powered by at least compressor 10. As fluid is forced through grooves 56 of first rotor 24, it passes over and exhausts into recirculation vent channels 48. When the compressed fluid system requires air end 10 to operate at full capacity, valve plate 74 is in a closed position, all the fluid in main fluid chamber 22 is forced from the inlet and through outlet orifice 46. As pressure builds up in fluid chamber 22 pressure is exerted onto top surface 80 of valve plate 74 when valve plate 74 is in a closed position. This pressure force is transferred through valve plate 74 and is substantially normal to top surface 88 of cover 14 resulting in valve plate 74 being forced downward against top surface 88 of cover 14. This normal force increases the friction force required to be overcome by valve motor 78 when rotating valve plate 74 relative to recessed portion 32 of bottom 30 of main housing 16. The configuration of valve plate bottom surface 82 to have recessed portions 98 and ribs 96 reduces the surface area of bottom surface 82 of valve plate 74 in contact with top surface 88 of cover 14. The reduced surface area reduces the frictional force required to be overcome by valve motor 78 to rotate valve plate 74. The absence of recessed portions 98 and ribs 96 would result in the motor having to be a large size to provide sufficient torque to overcome the frictional force.

When the compressed fluid system of the present invention does not require the full operational capacity of air end 10, slide valve assembly 12 may be utilized to reduce the volume of fluid forced out of air end 10 during the operation of the air end. Valve plate 74 may be radially translated by valve motor 78 to an intermediate position that closes a portion of vent channels 48 and opens a portion of vent channels 48 for fluid flow from main fluid chamber through vent channels 48 into recirculation chamber 90 and, because outlet 150 puts recirculation chamber 90 in fluid communication with inlet orifice 44, fluid from recirculation chamber 90 is drawn into inlet orifice 44 and is further drawn back into main fluid chamber 22.

When the compressed fluid system powered by at least compressor 10 of the present invention requires little to no fluid output, valve motor 78 may be powered to rotate valve plate to a fully open position. The pattern of vent channels 48 may be configured such that the entirety of fluid drawn into main fluid chamber 22 of air end 10 exits out vent channels 48 when valve plate 74 is in the fully open position. If required, the pattern of vent channels 48 may also be configured to allow a minimal amount of fluid to be forced out of air end 10 in order to maintain a uniform fluid pressure in the compressed fluid system. As described above, air end 10 is configured such that the vented fluid in chamber 90 is drawn back into inlet orifice 44 and is further drawn back into main fluid chamber 22. When valve plate 74 is positioned in a fully open position, the same volume of fluid may be repeatedly cycled through the vent channels 48 until an increase in output of air end 10 is required by the system while compressor of which the air end is a part is continually operating. This allows the air end 10 to be continuously operated thereby providing a quicker response to the increases in demand by the compressed fluid system supplied at least in part by air end 10 of the present invention. The increase in demand may be satisfied by varying the position of valve plate 74 with respect to the pattern of vent channels 48 in main housing 16. This results in a more responsive compressed fluid system and may increase the efficiency of the system From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

We claim:

1. An assembly of a compressor for pressurizing a fluid comprising:

a main housing having a portion being substantially planar;

at least two parallel intersecting bores;

at least two rotors journaled for rotation within said bores;

a cover;

a plurality of vent channels in said main housing extending outwardly from at least one bore of the two parallel intersecting bores through said portion being substantially planar; the vent channels are configured for the fluid to flow through said vent channels;

a slide valve assembly operably connected to said housing proximate said plurality of vent channels, said slide valve assembly having a valve plate;

wherein said valve plate has a substantially planar side that is sealingly engaged with said planar portion of said main housing and rotatable relative to said planar portion of said main housing;

wherein said valve plate is positioned into one of a plurality positions relative to said vent channels, wherein said position in which said valve plate is positioned is are selected from a group comprising of: a fully open position, a fully closed position, and an intermediate position; and wherein said valve plate comprises a side opposite said planar side, said side opposite bearing against said cover, said side opposite has a recess which does not bear against said cover, said cover delimiting a chamber, said chamber also delimited by a portion of said main housing.

2. The assembly of the compressor for pressurizing a fluid of claim 1 wherein said valve plate is variably rotatable from said closed position to said open position.

* * * * *